United States Patent [19]

Whitehead

[11] 4,295,234

[45] Oct. 20, 1981

[54] BED FRAME

[75] Inventor: Larry W. Whitehead, Lexington, N.C.

[73] Assignee: Leggett & Platt, Incorporated, Carthage, Mo.

[21] Appl. No.: 116,220

[22] Filed: Jan. 28, 1980

[51] Int. Cl.[3] ..... A47C 19/04

[52] U.S. Cl. ..... 5/184; 5/202; 403/107

[58] Field of Search ..... 5/181, 182, 184, 200-202; 403/107

[56] References Cited

U.S. PATENT DOCUMENTS

| | | | |
|---|---|---|---|
| 3,795,022 | 3/1974 | Harris | 5/181 |
| 3,871,039 | 3/1975 | Garceau et al. | 5/181 |
| 4,192,028 | 3/1980 | Knoke | 5/181 |

*Primary Examiner*—Ramon S. Britts

*Assistant Examiner*—Alexander Grosz

*Attorney, Agent, or Firm*—Wood, Herron & Evans

[57] ABSTRACT

An adjustable bed frame having a pair of side rails interconnected by a pair of adjustable cross rail assemblies. The cross rail assemblies each include a pair of rails of L-shaped cross section. A fastenerless latch mechanism is provided for retaining the cross rails in a position of adjustment. The latch mechanism comprises a headed protrusion extending from one of the cross rails and fitted within a slot of the other rail and a protrusion on the other rail fitted within an aperture of the first rail, the two protrusions being located on mutually perpendicular legs of the respective rails. The two cross rails are locked in this assembled relation by a pivotable latch fixedly secured to one of the rails and movable into a position of engagement with the rails so as to secure their respective protrusions against relative movement.

6 Claims, 5 Drawing Figures

BED FRAME

This invention pertains to metal bed frames and particularly to bed frames of the type which have relatively adjustable cross rails for the purpose of providing adjustment to the width of the side rails so as to accommodate various widths of bedding. This type of bed frame is well-known in the art and has been commercially available for many years.

Quite commonly, adjustable bed frames are so constructed that they may be assembled without the use of any losse fasteners, such as conventional nuts and bolts. By eliminating loose fasteners the possibility of any parts becoming lost is avoided and the speed with which the bed frames may be assembled in any one of the various positions of adjustment is accelerated.

One recent approach to a loose fastenerless adjustable bed frame is disclosed in U.S. Pat. No. 3,795,022 in which there is a pivoted latch movable through aligned apertures of interfitting bed rail sections to secure the bed rail sections in various positions of adjustment. Another approach to this same problem is disclosed in U.S. Pat. No. 3,871,039 in which a pivoted latch is movable through aligned openings of telescopingly interfitted channel-shaped bed cross rails to secure the bed frame in an adjusted position. In the case of the bed frames disclosed in both of these patents, the bed frame may be very quickly assembled or disassembled without the possibility of any parts becoming lost, but the bed frame disclosed in both of these patents suffers from the fact that the frame elements must have apertures punched or cut therein through which the pivoted latching element must pass to secure the interfitting cross rails in a locked and assembled position. These apertures greatly weaken the bed rails at the aperture location since they require the removal of a substantial quantity of metal at the latching sites.

It has therefore been an objective of this invention to provide an improved adjustable bed frame assembly having a pivoted latch for securing the bed frame cross rails in various positions of adjustment but without the necessity for holes to be punched or cut in the metal for insertion of the latching element.

This objective is achieved by the improved bed frame of the present invention in which the interfitting cross rails are secured in a position of adjustment by a latch which is not required to pass through apertures or holes in the cross rails. Rather, according to the practice of this invention the cross rails are in the form of angle irons having an L-shaped cross section. One of these interfitting cross rails has a shouldered rivet or protrusion extending therefrom engageable with any one of a plurality of longitudinally aligned slots in the other cross rail. There is also a second protrusion upon one of the cross rails engageable within a series of longitudinally aligned apertures of the other cross rail, the two protrusions being located in mutually perpendicular legs of the cross rails within which they are located. A pivoted latch secures the cross rails in the assembled position in which the protrusions are located within their respective slot and aperture by securing locking arms and attached fingers over overlapping juxtapositioned sections of the interfitted cross rails.

The above described adjustable bed frame is at once very easily and inexpensively fabricated, yet when used in a complete bed frame provides very strong and reliable support for bedding of various typical sizes. The L-shaped cross section side and cross rails may be fabricated from conventional commercially available angle iron stock and that stock need not be weakened by apertures to accommodate the pivoted lock for securing the cross rail sections in any one of several different positions of adjustment as in the above identified prior art patents.

These and other objects and advantages of this invention will be more readily apparent from the following description of the drawings in which.

Figure 1:
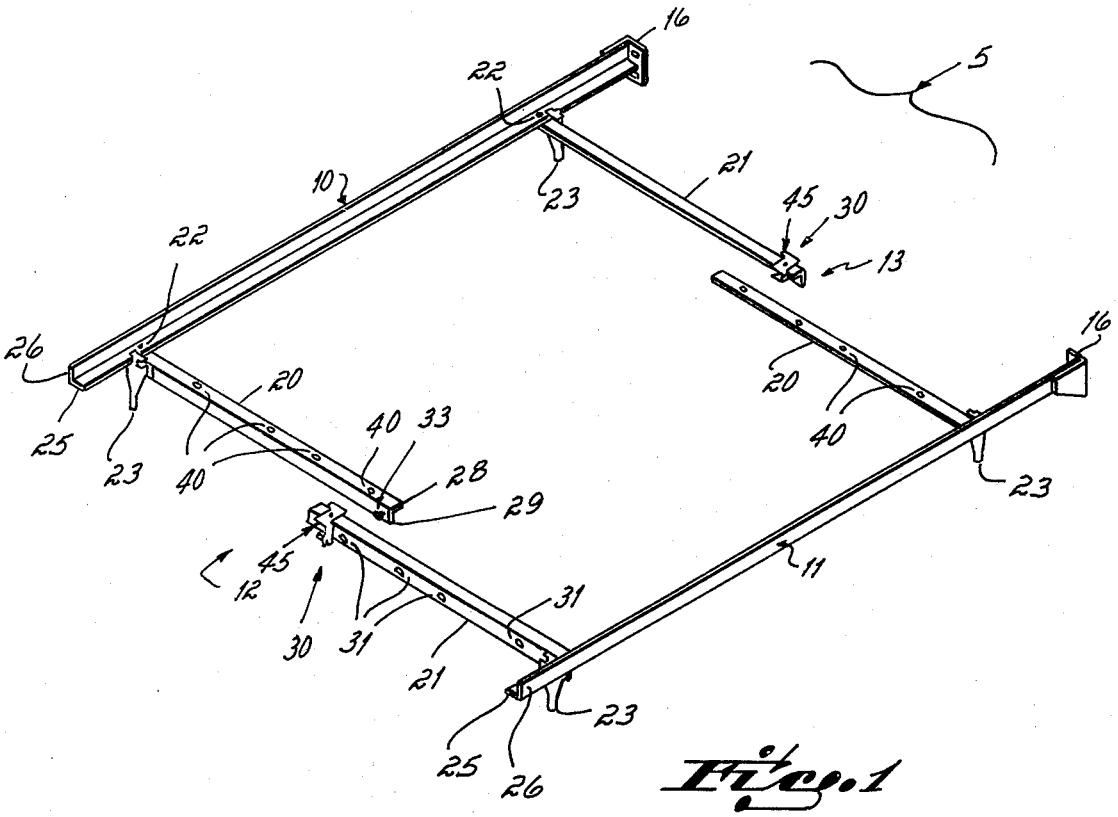
FIG. 1 is an exploded perspective view of a bed frame incorporating the invention of this application.
Figure 2:
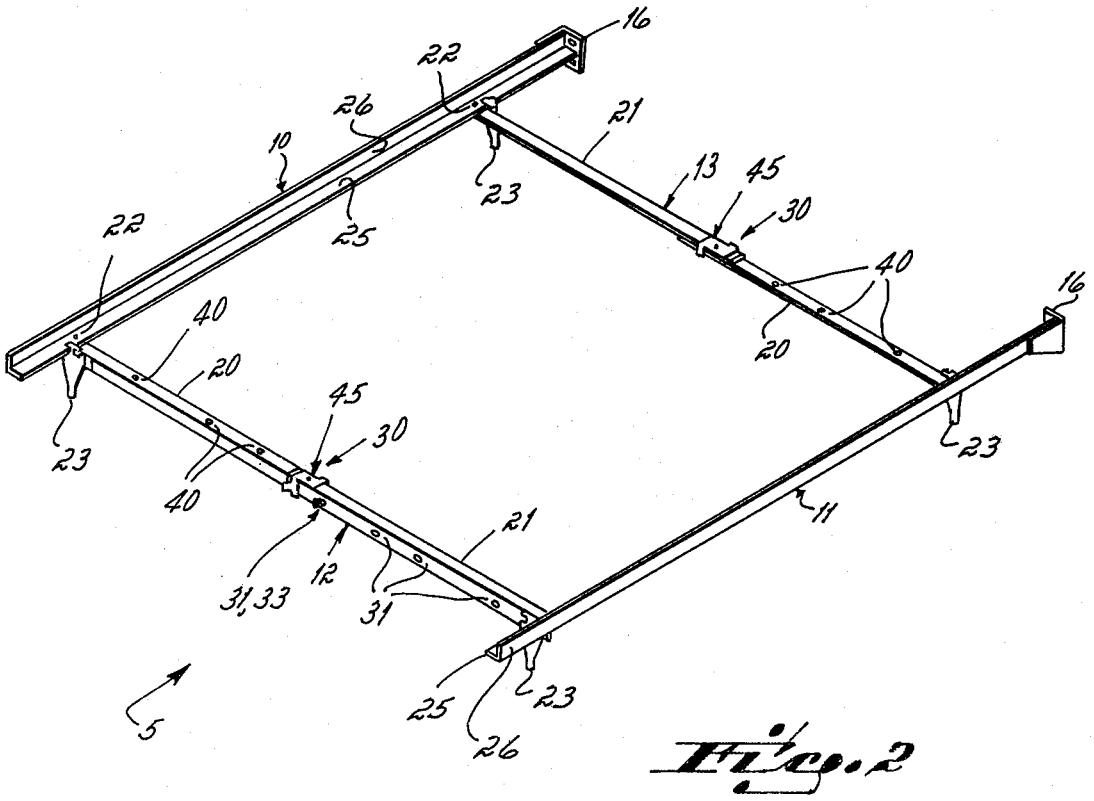
FIG. 2 is an assembled perspective view of the bed frame of FIG. 1.

The invention of this application is illustrated as applied to a Hollywood type bed frame 5. As may be seen in FIG. 1 this bed frame includes a pair of rails 10, 11 which extend longitudinally and are interconnectable by cross rail assemblies 12, 13. Headboard brackets 16 are fixedly secured at one end of the side rails 10, 11.

Each cross rail assembly comprises a pair of cross rails 20, 21 pivotally secured to one of the side rails 10, 11 by a rivet 22. A leg structure 23 is secured to each of the cross rails and is operative to lock the cross rails in a position perpendicular to the side rails. A complete description of the leg structure and its interconnection to the side rails may be found in Hooker U.S. Pat. No. 4,106,141.

The side rails 10, 11 and cross rails 20, 21 are all manufactured from conventional angle iron of the type which is L-shaped in cross section. In the case of the side rails the angle iron is so positoned that one leg 25 is located in a horizontal plane and the other leg 26 extends upwardly from the horizontal leg such that a bedding foundation or so-called box spring may be placed atop horizontal leg 25 and between the vertical legs 26 of the two cross rails.

The L-shaped cross rails 20, 21 have one leg 28 located in a horizontal plane and the other leg 29 extending downwardly from the horizontal leg. It is the two horizontal legs 28 and 25 of the cross rails and side rails which are pivotally interconnected by the pivot 22.

The invention of this application is directed to a fastenerless mechanism 30 for securing the cross rails 20, 21 in any one of several different positions of adjustment such that the bed frame will accommodate bedding of varying widths. This mechanism 30 permits adjustment of the cross rails so as to enable the interfitted and locked cross rails to vary in combined length. By varying that length the distance between the side rails 10, 11 may be changed or adjusted so as to accommodate standard widths of bedding, namely 3/3 commonly known as twin size; 4/0 commonly known as three-quarter size; 4/6 commonly known as full size; and 5/0 commonly known as queen size.

Fastenerless Mechanism

The fastener mechanism 30 comprises four keyhole or teardrop shaped slots 31 located in the vertical leg 29 of the cross rail 21. These slots 31 are adapted to receive a headed rivet 33 attached to the vertical leg 29 of the cross rail 20. This rivet has a head section 34 which fits through the larger end of the keyhole shaped slot 31 but sized such that the head 34 cannot be moved back through the slot when the rivet is moved to the smaller diameter end 35 of the slot.

Extending through the horizontal leg 28 of the cross rail 20 there are four circular apertures 40. These apertures 40 are spaced from each other the same relative distance as the keyhole shaped slots 31 are spaced one from the other. As explained more fully hereinafter these apertures 40 are adpated to selectively receive a pin 41 of a pin rivet 42 when the cross rails are secured in any one of the four illustrated positions of adjustment.

Pivotally mounted upon the top of the horizontal leg 28 of the cross rail 21 is a pivot clamp 45. This pivot clamp is secured to the leg 28 by the rivet pin 42.

The pivot clamp comprises a planar body 46 which rests atop the horizontal leg 28 of cross rail 21. Arms 47, 48 depend downwardly from opposite ends of the body 46 on opposite sides of the horizontal leg 28 of rail 21. There are fingers 49, 50 extending inwardly beneath the body at the end of both arms 47, 48, respectively, remote from the body 46. These fingers are adapted, when the pivot clamp is rotated from the position illustrated in FIG. 4 to the position illustrated in FIG. 5, to pass beneath the juxtapositioned edges 51 of the vertical legs 29 of the interfitted cross rails 20, 21 and beneath the juxtapositioned edges 52 of the horizontal legs 28 of the rails 21, 20.

There is a dimple 53 extending upwardly out of the plane of the finger 49 and adapted to frictionally contact the lower edge 51 of the cross rail 20 when the clamp is moved into the locked position. In the locked position this dimple is located beneath the horizontal leg 28 of the rail 20 (see FIG. 5) such that the lock cannot be rotated to an unlocked condition without overcoming the frictional resistance as the dimple engages and passes beneath the edge 51 of the rail 20. Thus, the dimple 53 cooperates with the edge of the rail to form a frictional interlock operable to prevent inadvertent unlocking of the pivot latch.

Figure 3:
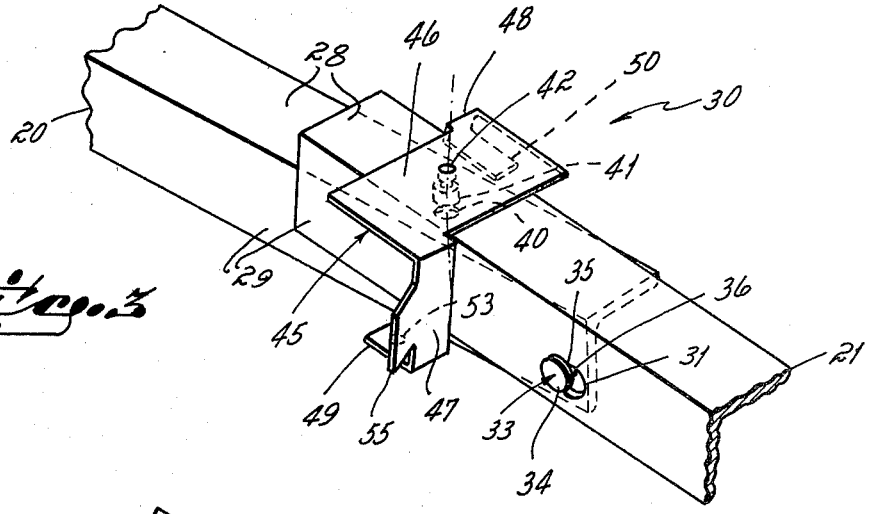
FIGS. 3, 4 and 5 are enlarged fragmentary views illustrating the bed frame's fastenerless mechanism in a clamping sequence.

In operation, the assembly and locking of the cross rails 20, 21 in an adjusted position is a three step process. First, the rails 20, 21 must be positioned in an angular position relative to each other as illustrated in FIG. 3 and with the cross rail 20 located beneath the cross rail 21. In this angular position of the rails the headed rivet 33 is inserted into one of the keyhole slots 31. The rails are then shifted axially apart so as to move the neck 36 of the headed rivet 33 into the smaller diameter end 35 of the keyhole slot 31, in which position the head 34 of the rivet prevents the rivet from moving axially out of the slot. The overlapped cross rails 20, 21 are then pivoted into a common plane so as to locate the pin 41 of the pin rivet in one of the apertures 40. With the pin 41 located in the aperture 40 the cross rails are locked against relative longitudinal movement.

Figure 4:
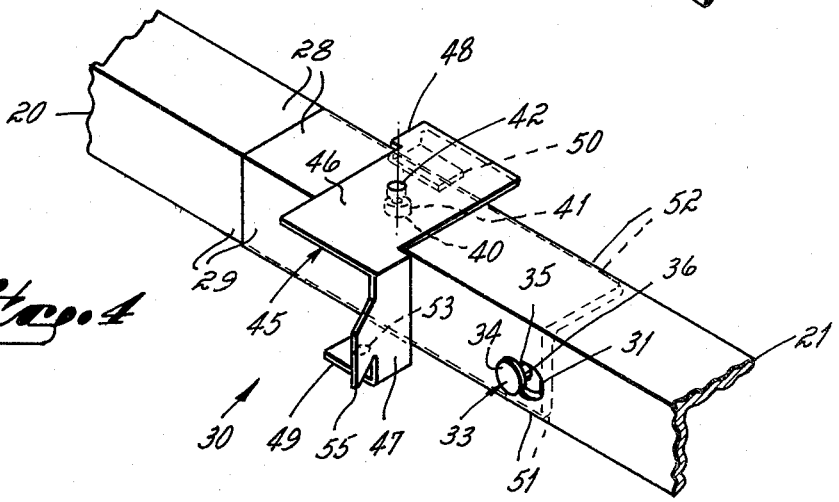
Figure 5:
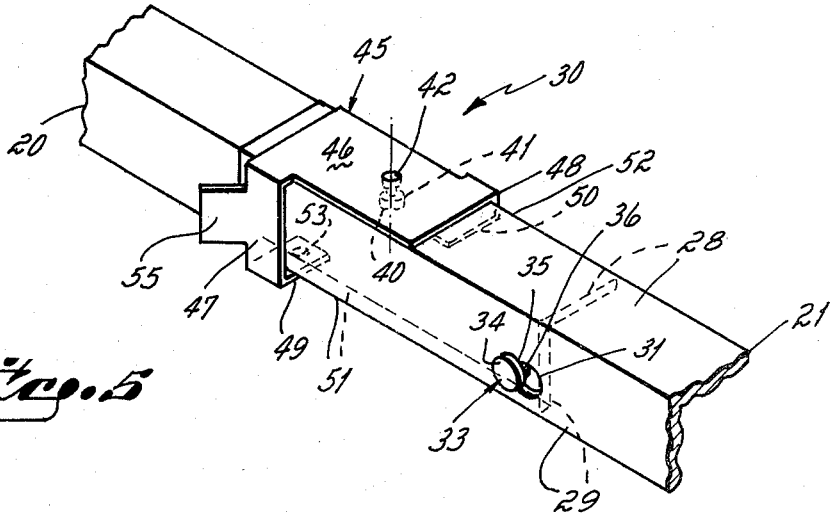

The third and last step in the assembly process is to rotate the pivot clamp 45 from the position illustrated in FIGS. 1 and 4 to the position illustrated in FIG. 5. In this latter position the finger 49 of the clamp moves beneath the vertical legs 29 of the cross rails 20, 21 and the finger 50 moves beneath the horizontal legs 28 of the cross rails 20, 21. In the course of being rotated the dimple 53 on leg 49 passes beneath and physically contacts the bottom edges 51 of the vertical legs 29. This contact results in some frictional resistance to turning movement of the clamp, but this resistance is easily overcome by continued rotation of the clamp ends. When the arm 47 of the clamp contacts the vertical leg of the rail 21, the two cross rails are locked in a position of adjustment.

To unlock the clamp there is a thumb flange 55 which extends outwardly from the arm 47. When the arm 47 is located in juxtaposition to the vertical leg 29 of the rail 21 this thumb latch flange extends out and away from the vertical leg 29 a sufficient distance to enable a person's thumb to fit beneath it for purposes of pulling the latch to the unlocked position illustrated in FIG. 4.

The primary advantage of the fastenerless cross rail adjustment mechanism of this invention is that it may be inexpensively fabricated upon conventional angle iron cross rails without materially effecting the strength of the angle iron. Additionally, it has the advantage of being easily operable to lock or unlock the latch for assembly and disassembly of the bed.

While I have described only a single preferred embodiment of my invention, I do not intend to be limited except by the scope of the following appended claims:

I claim:

1. A bed frame including a pair of side rails interconnected by a pair of adjustable elongated cross rail assemblies, said cross rail assemblies being fastened transversely between said pair of side rails so as to hold said side rails in spaced parallel relationship, each of said adjustable cross rail assemblies comprising, a pair of cross rails connected at one end to one of said side rails, each of said cross rails being L-shaped in cross section and having mutually perpendicular flat legs, one of said cross rails having a first shouldered protrusion extending from one leg thereof, the other of said cross rails having a plurality of longitudinally spaced slots adapted to receive said shouldered protrusion when said cross rails are located in any one of a plurality of overlapping face abutting positions of adjustment, said slots being configured so as to permit relative longitudinal movement of said first protrusion within said slots, one of said cross rails having a second protrusion extending from a leg thereof, the other of said cross rails having a plurality of longitudinally spaced apertures adapted to receive said second protrusion when said cross rails are located in any one of the plurality of overlapping positions of adjustment, said apertures being sized and configured so as to prevent relative longitudinal movement of said rails when said second protrusion is located within one of said apertures, said first and second protrusions extending from mutually perpendicular legs of said cross rails, and clamping means for locking said cross rails in one of said plurality of positions of adjustment.

2. The bed frame of claim 1 in which said clamping means comprises a clamp pivotally mounted on one of said cross rails.

3. The bed frame of claim 2 in which said clamp comprises a body having arms located at opposite ends thereof and extending perpendicular thereto, one of said arms being adapted to overlie one of said legs of said cross rails and the other of said arms being adapted to overlie juxtapositioned edges of said cross rails in the locked position of said clamping means, said arms having fingers extending perpendicular thereto, the finger of said one arm being adapted to overlie juxtapositioned edges of said cross rails in the locked position of said clamping means and the finger of other of said arms being adapted to overlie one leg of one of said cross rails in the locked position of said clamping means.

4. A bed frame including a pair of side rails interconnected by a pair of elongated cross rail assemblies, said cross rail assemblies being fastened transversely between said pair of side rails so as to hold said side rails in spaced parallel relationship, each of said cross rail assemblies comprising, a pair of cross rails connected at one end to one of said side rails, each of said cross rails being L-shaped in cross section and having mutually perpendicular flat legs, one of said cross rails having a first shouldered protrusion extending from one leg thereof, the other of said cross rails having at least one slot adapted to receive said shouldered protrusion when said cross rails are located in a face abutting assembled position, one of said cross rails having a second protrusion extending from a leg thereof, the other of said cross rails having at least one aperture adapted to receive said second protrusion when said cross rails are located in said assembled position, said first and second protrusions extending from mutually perpendicular legs of said cross rails, and clamping means for locking said cross rails in said assembled position, said clamping means comprising a body pivotally mounted on one of said cross rails, said body having arms located at opposite ends thereof and extending perpendicular thereto, one of said arms being adapted to overlie one of said legs of said cross rails and the other of said arms being adapted to overlie juxtapositioned edges of said cross rails in the locked position of said clamping means, said arms having fingers extending perpendicular thereto, the finger of said one arm being adapted to overlie juxtapositioned edges of said cross rails in the locked position of said clamping means and the finger of other of said arms being adapted to overlie one leg of one of said cross rails in the locked position of said clamping means.

5. A bed frame including a pair of side rails interconnected by a pair of adjustable elongated cross rail assemblies, said cross rail assemblies being fastened transversely between said pair of side rails so as to hold said side rails in spaced parallel relationship, each of said adjustable cross rail assemblies comprising, a pair of cross rails connected at one end to one of said side rails, each of said cross rails being L-shaped in cross section and having mutually perpendicular horizontal and vertical legs, one of said cross rails having a first shouldered protrusion extending from the vertical leg thereof, the other of said cross rails having a plurality of longitudinally spaced slots adapted to receive said shouldered protrusion when said cross rails are located in any one of a plurality of overlapping face abutting positions of adjustment, one of said cross rails having a second protrusion extending from the horizontal leg thereof, the other of said cross rails having a plurality of longitudinally spaced apertures adapted to receive said second protrusion when said cross rails are located in any one of a plurality of overlapping positions of adjustment, and clamping means for locking said cross rails in one of said plurality of positions of adjustment, said clamping means comprising a body pivotally mounted on the horizontal leg of one of said cross rails, said body having at least one arm located at one end thereof and extending perpendicular thereto, said one arm having a finger extending perpendicular thereto, the finger of said one arm being adapted to overlie a portion of said cross rails in the locked position of said clamping means so as to secure said cross rails in overlapping face abutting positions of adjustment.

6. The bed frame of claim 1 in which said finger of said clamping means has a locking dimple extending therefrom for frictionally securing said clamping means against inadvertent movement out of said locked position.

* * * * *

UNITED STATES PATENT AND TRADEMARK OFFICE

CERTIFICATE OF CORRECTION

PATENT NO. : 4,295,234

DATED : Oct. 20, 1981

INVENTOR(S) : Larry W. Whitehead

It is certified that error appears in the above—identified patent and that said Letters Patent is hereby corrected as shown below:

Column 1, line 13 "losse" should be -- loose --

Column 2, line 21, insert -- side -- before "rails"

Column 3, line 8, "adpated" should be -- adapted --

Signed and Sealed this

*Sixteenth* Day of *March 1982*

[SEAL]

*Attest:*

GERALD J. MOSSINGHOFF

*Attesting Officer*

*Commissioner of Patents and Trademarks*